US009364057B2

(12) United States Patent
Halonen et al.

(10) Patent No.: US 9,364,057 B2
(45) Date of Patent: Jun. 14, 2016

(54) SPORTS OR FITNESS TRAINING POLE

(71) Applicant: E-Sports Group Oy, Espoo (FI)

(72) Inventors: Kari Halonen, Espoo (FI); Timo Bygden, Jämsänkoski (FI)

(73) Assignee: E-Sport Group Oy (FI)

( * ) Notice: Subject to any disclaimer, the term of this patent is extended or adjusted under 35 U.S.C. 154(b) by 0 days.

(21) Appl. No.: 13/936,687

(22) Filed: Jul. 8, 2013

(65) Prior Publication Data

US 2014/0014148 A1 Jan. 16, 2014

(30) Foreign Application Priority Data

Jul. 9, 2012 (FI) ..... 20124143 U

(51) Int. Cl.

| | |
|---|---|
| ***A45B 9/00*** | (2006.01) |
| ***A45B 7/00*** | (2006.01) |
| ***A63C 11/22*** | (2006.01) |

(52) U.S. Cl.

CPC ... *A45B 9/00* (2013.01); *A45B 7/00* (2013.01); *A45B 7/005* (2013.01); *A63C 11/227* (2013.01); *A45B 2009/005* (2013.01); *A45B 2200/055* (2013.01)

(58) Field of Classification Search

CPC ..... A45B 9/00; A45B 2200/05; A45B 2200/055; A45B 7/00; A45B 7/005; A63C 11/227; A63C 11/222; A63C 11/22

USPC ..... 135/65; 280/819, 821

See application file for complete search history.

(56) References Cited

U.S. PATENT DOCUMENTS

| | | | | | |
|---|---|---|---|---|---|
| 3,933,364 | A | * | 1/1976 | With | A63C 11/222 280/821 |
| 5,058,923 | A | * | 10/1991 | Dale | 280/821 |
| 5,482,072 | A | * | 1/1996 | Cimino | 135/72 |
| 5,490,825 | A | * | 2/1996 | Wilkinson | 482/74 |
| 5,505,492 | A | * | 4/1996 | Nelson et al. | 280/819 |
| 5,788,608 | A | * | 8/1998 | Wilkinson | 482/51 |
| 5,996,602 | A | * | 12/1999 | Cato, III | A45B 9/00 135/65 |

(Continued)

FOREIGN PATENT DOCUMENTS

| | | | | | |
|---|---|---|---|---|---|
| DE | FR 2381537 | A1 | * | 9/1978 | A63C 11/22 |
| DE | 19602721 | A1 | | 7/1997 | |
| DE | 19725268 | A1 | | 1/1998 | |
| EP | 1151767 | A1 | | 7/2001 | |
| EP | 1795238 | A1 | | 6/2007 | |
| EP | 1820544 | A1 | | 8/2007 | |
| FI | EP 1820544 | A1 | * | 8/2007 | A63C 11/22 |
| FR | 3004962 | A1 | * | 10/2014 | A63C 11/22 |

OTHER PUBLICATIONS

European Patent Office, "European Search Report" in connection with related European Patent Application No. 12194005.0-1653, 5 pgs., dated Jul. 31, 2013.

*Primary Examiner* — Noah Chandler Hawk

(74) *Attorney, Agent, or Firm* — Kolisch Hartwell, P.C.

(57) ABSTRACT

A sports or fitness training pole, such as a pole used in Nordic walking, roller skating or skiing, including a pole shaft, a grip fixed to the top end of the pole shaft, and a ring construction fixed to the bottom end of the pole shaft, where the pole shaft includes two curved parts curving in opposite directions. The first curved part is in the central region of the pole and the second curved part is between the first curved part and the grip, and with respect to a straight line passing through the first curved part and the grip, the pole shaft above the first curved part is located on the rear side of the straight line, while the grip is in a forward tilted position with respect to the straight line.

6 Claims, 1 Drawing Sheet

(56) References Cited

U.S. PATENT DOCUMENTS 6,733,042 B1 * 5/2004 Klemetti ..... A63C 11/222 280/819
7,896,013 B2 * 3/2011 Lerner ..... 135/65
2003/0227167 A1 * 12/2003 Redor et al. ..... 280/819
2008/0006314 A1 * 1/2008 Adams ..... A45B 1/00 135/65
2010/0282282 A1 * 11/2010 Campbell ..... A45B 9/02 135/77
2012/0318313 A1 * 12/2012 Dickerson, II ..... A61H 3/02 135/72

* cited by examiner

SPORTS OR FITNESS TRAINING POLE

The object of the invention is a sports or fitness training pole, such as a pole used in Nordic walking, roller skating or skiing, which comprises a pole shaft, a grip fixed to the top end of the pole shaft, the grip having a front side and a rear side, a ring construction fixed to the bottom end of the pole shaft, the ring construction being provided with a spike and/or a rubber tip, and a hand strap fixed to the grip, the strap being on the rear side of the grip and determining the position of the pole with respect to the direction of travel in such a way that the pole has a frontmost front side and a rearmost rear side in the direction of travel.

From the patent application FI20030128A is known a sports or fitness training pole provided with a grip, wherein the grip is tilted forward with respect to the longitudinal axis of the pole by means of a connecting piece between the grip and the pole shaft. The forward tilted position of the grip is advantageous particularly in walking poles, because it allows the wrist to be in its natural position. In this known solution, however, the pole shaft is left essentially completely outside the line which connects the grip and the pole's point of hit into the ground. This causes excessive bending of the pole and deterioration of its strength in connection with the impact on the ground, and the user also loses the feel of where the pole hits the ground.

The aim of the invention is to make possible the forward tilted position of the grip without the above-mentioned disadvantages.

This aim is achieved on the basis of the characteristics disclosed in the accompanying claim 1. The dependent claims disclose preferred embodiments of the invention.

Figure 1:
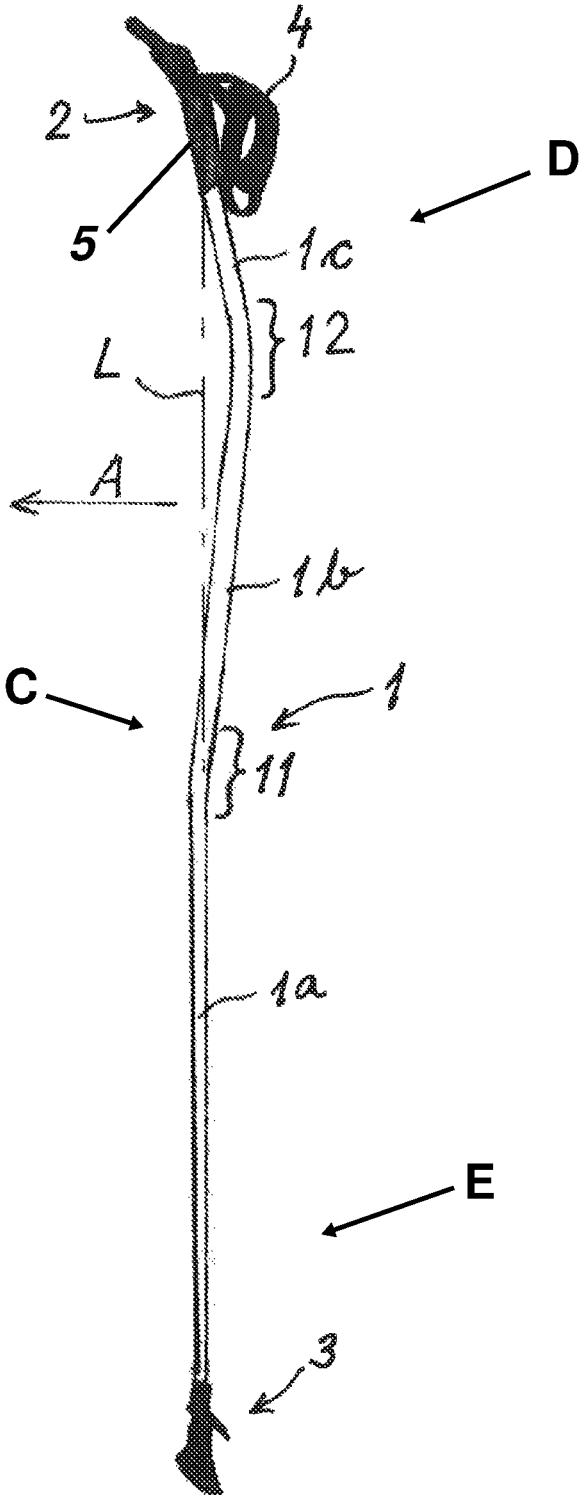
Figure 2:
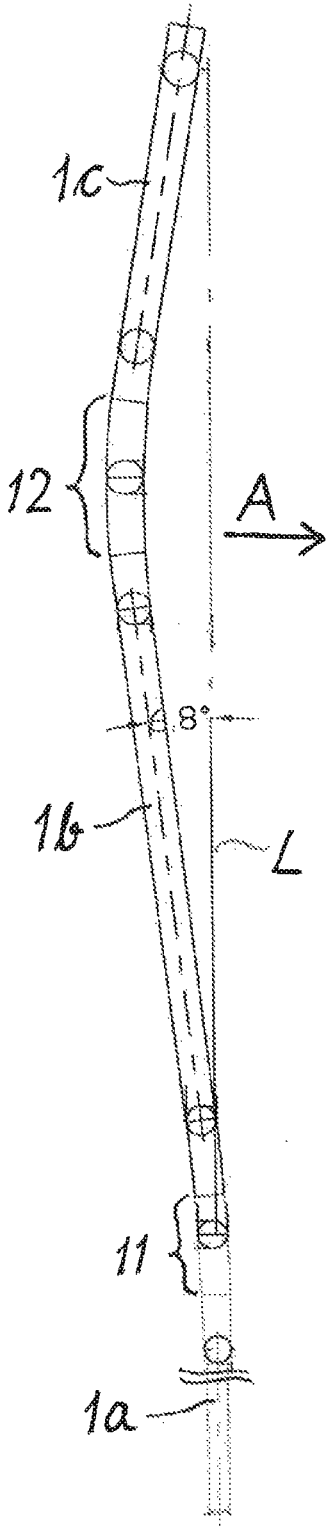

The invention is illustrated in the following by means of an example, with reference to the accompanying drawings, in which FIG. 1 shows one embodiment of the pole according to the invention as seen from the side, and FIG. 2 shows the pole shaft of the pole according to the invention on a larger scale.

The pole according to the invention comprises a grip 2 and a ring construction 3 and between them a pole shaft 1 which is preferably a structurally integral shaft. The pole shaft may be made of aluminium or a composite material.

On the rear side of the grip 2 fixed to the top end of the pole shaft is fixed a hand strap 4 which determines the position of the pole with respect to the direction of travel in such a way that the pole has a frontmost front side and a rearmost rear side in the direction of travel. The hand strap 4, therefore, guides the hand to grip the portion of grip 2 that is the portion configured to be grasped 5 in such a way that the pole 1 settles into the said position.

The structure of the ring 3 fixed to the bottom end of the pole may vary in many ways. In the case of a walking pole, the ring construction may include a fixed spike, which can be covered by a rubber tip which gives a grip on the asphalt.

The pole shaft 1 comprises two curved parts 11 and 12 curving in opposite directions. The first curved part 11 is in the central region C of the pole and the second curved part 12 is between the first curved part 11 and the grip 2. As a result, the pole shaft above the first curved part 11 is located on the rear side of the straight line L which passes through the first curved part 11 and the grip 2 (on the rear side with respect to the direction of travel A). At the same time, the grip 2 is in a forward tilted position with respect to the straight line L. The angle of tilt may vary within the range from 5 to 20°. The pole shaft part 1*a* below the first curved part 11 is a straight, downwards tapering cone. This pole shaft part 1*a* joins the straight line L. To the grip 2 is then transmitted the feeling of the pole hitting the ground in essentially the same way and at the same point, or slightly to the front of the point of hit of a straight pole. However, the forward tilted position of the grip gives the wrist a natural position of use. The force transmitted from the user's hand to the pole shaft gives a better thrust forward than the grip of a straight pole. However, the feeling of control on the pole remains good. Furthermore, the curved shape of the top part of the pole gives the pole appropriate flexibility, however, without the high-frequency oscillation found to be inconvenient, which occurs with a straight shaft.

There is a straight pole shaft part 1*c* between the second curved part 12 and the grip 2. There is a straight pole shaft part 1*b* also between the first and second curved parts. The pole shaft parts 1*b*, 12, 1*c* above the first curved part 11 are of essentially uniform thickness or slightly conical and formed by an integral shaft. As was already mentioned, the entire pole shaft 1 is preferably comprised of a structurally integral shaft. The length of the curved parts 11 and 12 is relatively short. Each curved part is preferably at most about 10% of the overall length of the entire pole, typically 5 to 10% of the length of the pole.

The diameter (e.g. 9.5 mm) of the bottom end of the pole shaft is typically about 55-60% of the diameter (e.g. 16-17 mm) of the top end of the pole shaft. Within the area of the curved parts, the pole shaft is flat, so that it is narrower in the lateral direction than in the direction of travel A (e.g. 90-93% of the diameter of the direction of travel). In other areas, the pole shaft may be round. The pole shaft parts 1*a* and 1*b* may also be slightly conical.

By the central region C of the pole is here referred to that half of the length of the pole which remains between the upper quarter D and the lower quarter E of the length of the pole, or preferably that third part of the length of the pole which remains between the upper and lower third.

The invention claimed is:

1. A sports or fitness training pole, the training pole comprising:

a pole shaft having a pole length and a central region, the central region of the pole shaft being no more than one-half of the pole length and being disposed between an upper and lower quarter of the pole length;

a grip fixed to a top end of the pole shaft, the grip having a front side and a rear side;

a hand strap fixed to the rear side of the grip, thereby determining an orientation of the training pole with respect to a direction of travel; and a ring construction fixed to a bottom end of the pole shaft; wherein the training pole has a frontmost front side and a rearmost rear side with respect to the direction of travel; and the pole shaft has no more than two curved parts, including a first curved part in the central region of the pole and a second curved part between the first curved part and the grip, the two curved parts curving in opposite directions such that the pole shaft above the first curved part is disposed rearwardly of a straight line extending through the first curved part and the grip, the pole shaft below the first curved part is a straight, downwards-tapering cone parallel to and coincident with the straight line, the portion of the grip configured to be grasped is tilted toward the front side of the training pole at an angle of from 5 to 20° relative to the straight line, the entire portion of said pole shaft between the second curved part and the grip is straight and deviates rearwardly of the straight line so that a distance between the straight pole shaft portion between the second curved part and the grip and the straight line increases from the grip downward to the second curved part, and each curved part is at most about 10% of the pole length.

2. The training pole of claim 1, wherein the ring construction includes at least one of a spike and a rubber tip.

3. The training pole of claim 1, wherein the pole shaft is straight between the first and second curved parts.

4. The training pole of claim 1, wherein the portion of the pole shaft between the first curved part and the grip is an integral shaft that is of essentially uniform thickness or is slightly conical.

5. The training pole of claim 1, wherein the portion of the pole shaft extending between the grip and the ring construction is a structurally integral shaft, and the angle between the forwardly-tilted grip and the straight line is within a range of 5° to 20°.

6. The training pole of claim 1, where the training pole is configured to be used in conjunction with Nordic walking, roller skating, or skiing.

* * * * *